US007162779B2

(12) United States Patent
MacHacek

(10) Patent No.: US 7,162,779 B2
(45) Date of Patent: Jan. 16, 2007

(54) WATER-RESISTANT ZIPPER WITH SLIDER

(75) Inventor: Zdenek MacHacek, Nanuet, NY (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/059,254

(22) Filed: Feb. 16, 2005

(65) Prior Publication Data

US 2006/0179620 A1 Aug. 17, 2006

(51) Int. Cl.
*B65D 33/16* (2006.01)

(52) U.S. Cl. ..... 24/399; 24/400; 383/64

(58) Field of Classification Search ..... 24/400, 24/399, 30.5 R, 585.12; 383/64; *A44B 19/16*
See application file for complete search history.

(56) References Cited

U.S. PATENT DOCUMENTS 4,778,282 A * 10/1988 Borchardt et al. ..... 383/63
6,047,450 A * 4/2000 Machacek et al. ..... 24/399
6,581,249 B1 * 6/2003 Savicki et al. ..... 24/30.5 R
6,595,689 B1 * 7/2003 Borchardt et al. ..... 383/64
6,605,026 B1 * 8/2003 Tomic ..... 493/394
6,915,546 B1 * 7/2005 Kasai ..... 24/30.5 R
6,948,848 B1 * 9/2005 Ausnit ..... 383/64
2003/0194155 A1 * 10/2003 Plourde ..... 383/64
2003/0231809 A1 * 12/2003 Bentsen ..... 383/59

* cited by examiner

*Primary Examiner*—Robert J. Sandy
*Assistant Examiner*—Marcus Menezes
(74) *Attorney, Agent, or Firm*—Pitney Hardin LLP

(57) ABSTRACT

A water-resistant zipper with interlocking profiles for a reclosable bag is disclosed. The zipper includes a first profile with upper and lower legs forming an engagement area therebetween. The upper and lower legs terminate in hooks extending into said engagement area. The lower leg further includes a downwardly extending arm. The second profile includes a male detent element which is detent engaged within the engagement area. The second profile further includes a first post which urges against the downwardly extending arm at all locations where the profiles are captured within a slider, thereby maintaining a water-resistant configuration. The second profile further includes a second post which urges against the upper leg when the first and second profiles are interlocked with each other.

7 Claims, 5 Drawing Sheets

WATER-RESISTANT ZIPPER WITH SLIDER

BACKGROUND OF THE INVENTION

1. Field of the Invention

This invention pertains to a zipper for a reclosable bag, wherein the zipper is water-resistant.

2. Description of the Prior Art

In the prior art, it is well known to use zippers and sliders in reclosable bags. These reclosable bags have been particularly useful for containing and transporting dry materials, such as snack foods. While these reclosable bags have been satisfactory for their intended uses, the need has arisen for the containment and transportation of liquids. However, many prior art zippers have not held liquids securely. Therefore, improvements are desired in the use of zippers and sliders for the containment and transportation of liquids.

OBJECTS AND SUMMARY OF THE INVENTION

It is therefore an object of the present invention to provide a zipper with a slider which is water-resistant and therefore suitable for reclosable bags intended for the containment and transportation of liquids.

This and other objects are attained by providing a zipper with a male profile and a female profile. The zipper further includes a slider. The male profile includes first and second posts and a male detent element therebetween. The female profile includes two legs terminating in inwardly extending hooks thereby forming an engagement area for receiving the male detent element. One of the legs of the female profile includes a downwardly extending arm. In the interlocked or closed position, the male element is received with the engagement area and a first water-resistant engagement is formed between the upper post of the male profile and the upper arm of the female profile. Additionally, at all positions where the zipper is captured within the slider, a water-resistant engagement is formed between the distal end of the lower post of the male profile and the downwardly extending arm of the female profile. The slider opens the zipper firstly by pressing the lower post of the male profile against the downwardly extending arm of the female profile thereby releasing the male detent element from the engagement area, and secondly by displacing the male profile upwards thereby separating the profiles from each other.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENT

Figure 1:
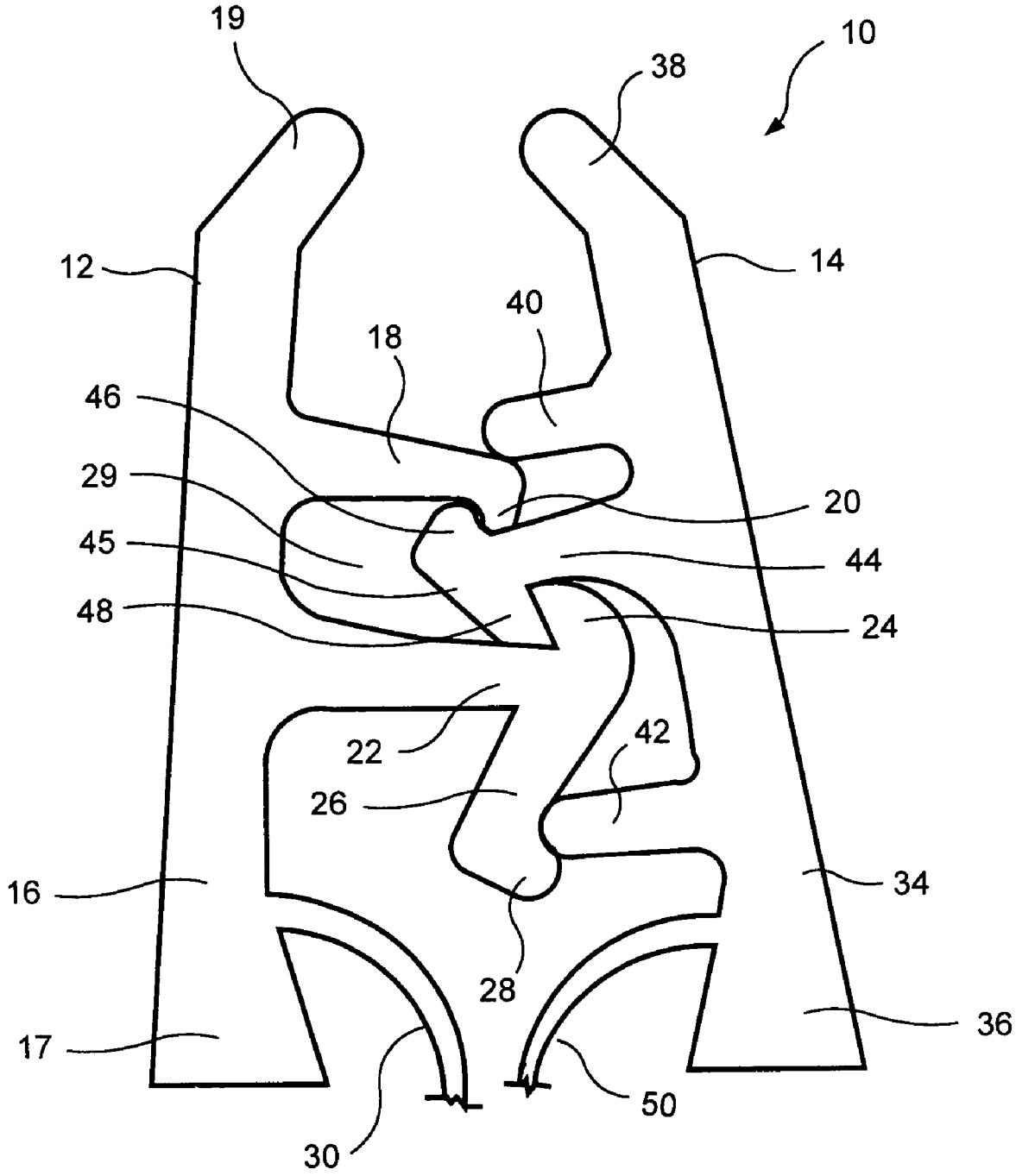
FIG. 1 is a cross-sectional view of the interlocked profiles of the zipper of the present invention.

Referring now to the drawings in detail wherein like numerals refer to like elements throughout the several views, one sees that FIG. 1 is a cross-sectional view of zipper 10 comprising first (or female) interlocking profile 12 and second (or male) interlocking profile 14. First (or female) interlocking profile 12 includes body 16 extending from base 17 and terminating in first upper inwardly inclined element 19. First interlocking profile 12 further includes upper female leg 18 extending inwardly and terminating in downwardly extending female hook 20. First interlocking profile 10 further includes lower female leg 22 extending inwardly and terminating in upwardly extending female hook 24 and downwardly extending arm 26. Downwardly extending arm 26 terminates in outwardly extending hook 28.

Engagement area 29 is formed between upper and lower legs 18, 22.

First flange 30 extends inwardly and downwardly from base 17 of first interlocking profile 12.

Second (or female) interlocking profile 14 includes body 34 extending from base 36 and terminating in second upper inwardly inclined element 38. In the configuration of FIG. 1, body 16 and body 34 are inclined with respect to each other in an A-type shape. Second interlocking profile 14 further includes upper inwardly extending post 40 which, when first and second profiles 12, 14 are in an interlocked configuration, urges against upper female leg 18 in a water-resistant configuration and lower inwardly extending post 42 which urges against the seat of downwardly extending arm 26 and outwardly extending hook 28 in a water-resistant configuration. The water-resistant configuration of lower inwardly extending post 42 against the seat of downwardly extending arm 26 and outwardly extending hook 28 is maintained throughout all locations where the first and second profiles 12, 14 are captured within slider 60. Second interlocking profile 14 further includes intermediate inwardly extending male element 44 which terminates in an enlarged detent head 45 comprising upwardly extending male hook 46 and downwardly extending male hook 48. In the interlocked configuration of first and second profiles 12, 14 as shown in FIG. 1, male hooks 46, 48 are received within engagement area 29 whereby upwardly extending male hook 46 engages downwardly extending female hook 20 and downwardly extending male hook 48 engages upwardly extending female hook 24.

Second flange 50 extends inwardly and downwardly from base 36 of second interlocking profile 14. Flanges 30, 50 are sealed to the front and rear walls of a reclosable plastic bag (not shown).

Figure 10:
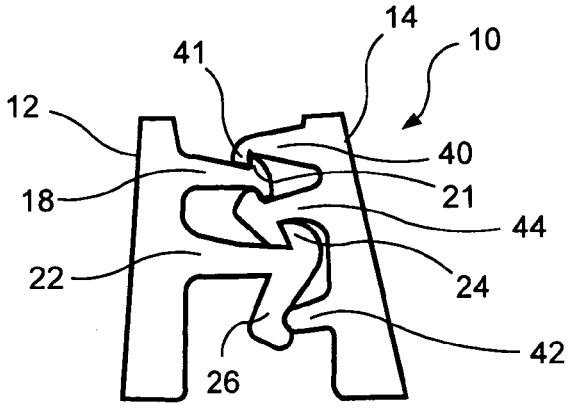
FIG. 10 is a cross-sectional view of an additional embodiment of the zipper of the present embodiment.

As shown in FIG. 10, an alternative embodiment may achieve a more robust water-resistant configuration by providing hook 41 on the end of upper inwardly extending post 40 to engage a second hook 21 on upper leg 18.

Figure 2:
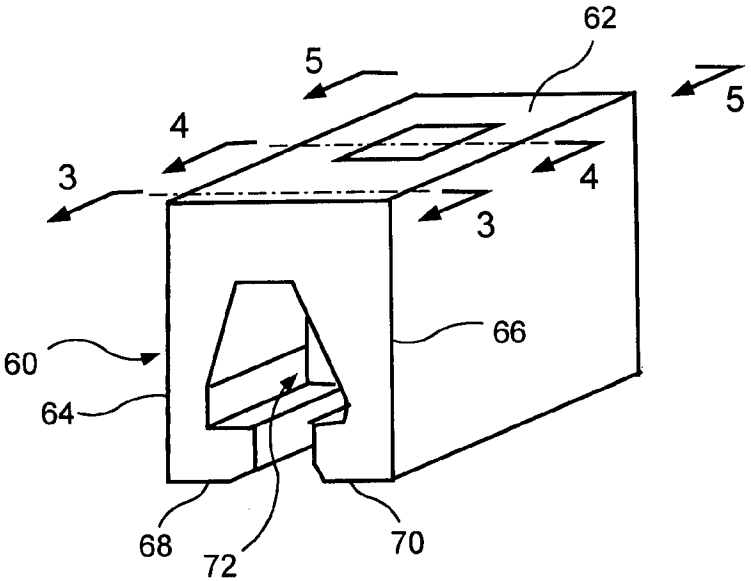
FIG. 2 is a perspective view of the slider of the present invention.
Figure 4:
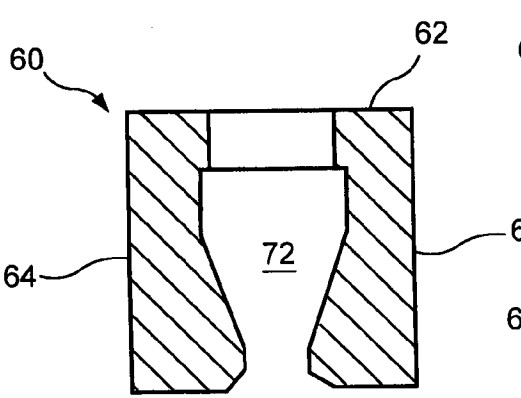
FIG. 4 is a cross-sectional view along plane 4—4 of FIG. 2, illustrating the unlocking section of the slider.
Figure 3:
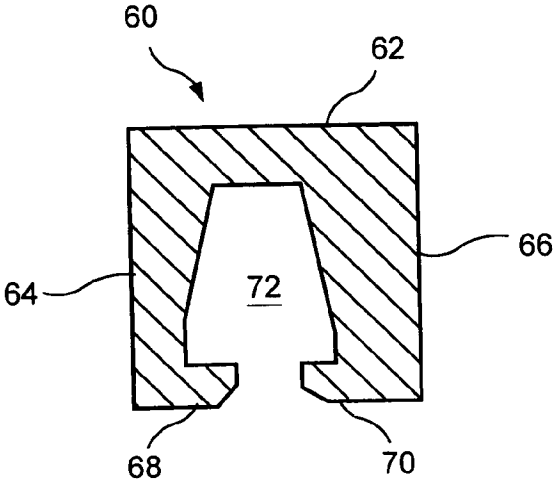
FIG. 3 is a cross-sectional view along plane 3—3 of FIG. 2, illustrating the interlocking section of the slider.
Figure 5:
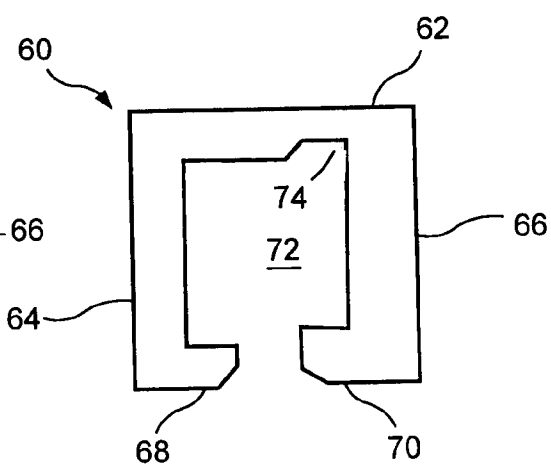
FIG. 5 is a cross-sectional view along plane 5—5 of FIG. 2, illustrating the separating section of the slider.

FIG. 2 is a perspective view of the slider 60 which is moved in a first direction to interlock first and second profiles 12, 14 with each other and in a second direction to disengage first and second profiles 12, 14 from each other. Slider 60 includes top wall 62, downwardly extending walls 64, 66, and inwardly extending flanges 68, 70 at bottom ends of respective side walls 64, 66. Profile engaging area 72 formed between side walls 64, 66 has a varying profile as shown in the cross-sectional views of FIGS. 3–5. FIG. 3 is a cross-sectional view wherein the interior of side walls 64, 66 forms a truncated triangular or A-shaped area thereby forming an interlocking section for engaging the first and second profiles 12, 14 with each other. FIG. 4 is a cross-sectional view wherein the interior of side walls 64, 66 forms an inverted truncated substantially triangular or V-shaped area thereby forming an unlocking section for disengaging the first and second profiles 12, 14 from each other. FIG. 5 is a cross-sectional view wherein the interior of side walls 64, 66 forms a substantially square area with recess 74 on a portion of the interior of the top wall 62 so that the upward offset of inwardly extending flange 70 in this cross-sectional view forces profile 14 upwardly so as to separate form profile 12.

Figure 11:
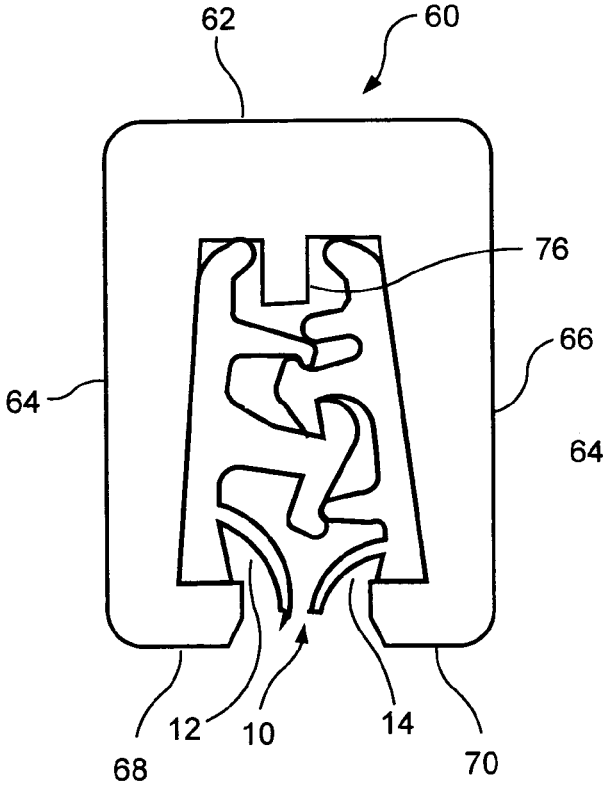
FIG. 11 is an alternative cross-sectional view along plane 3—3 of FIG. 2, showing the slider including an internal finger, and additionally showing the profiles of the zipper in the separated configuration.
Figure 12:
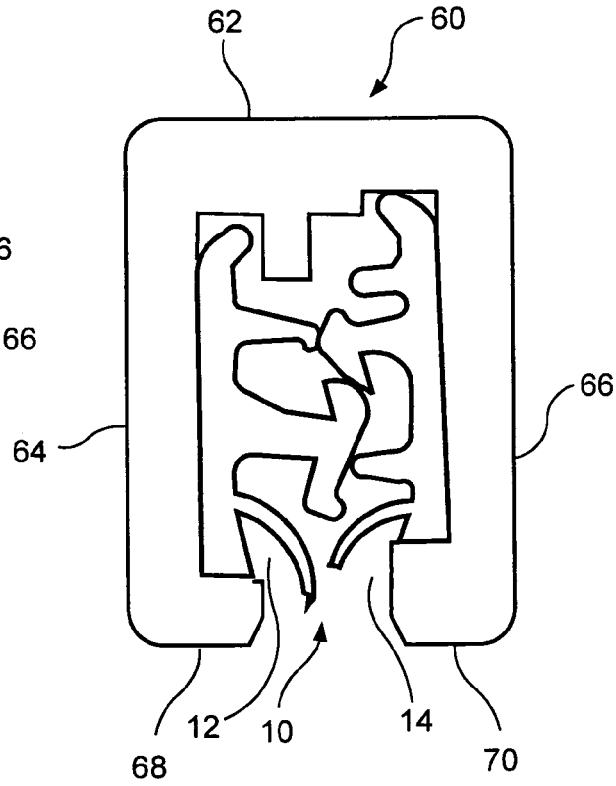
FIG. 12 is an alternative cross-sectional view along plane 1—1 of FIG. 2, showing the slider including an internal finger, and additionally showing the profiles of the zipper in the interlocked configuration.

An alternative embodiment of slider 60 is illustrated in FIGS. 11 and 12 (including first and second profiles 12, 14) corresponding to FIGS. 3 and 5, respectively, which further includes separating finger 76 in a central portion of an interior of top wall 62.

Figure 6:
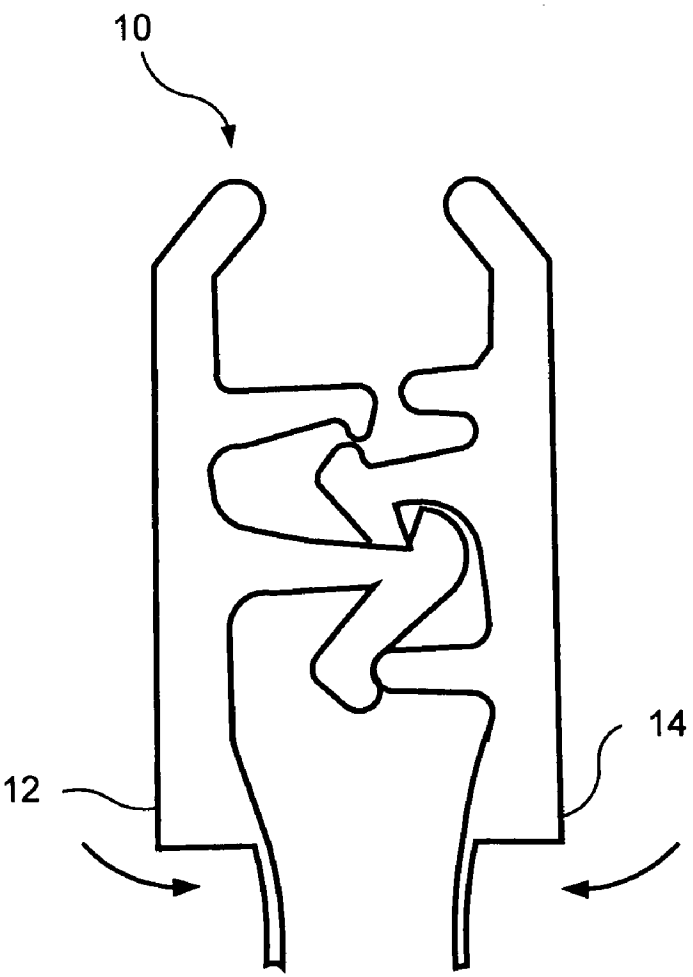
FIG. 6 illustrates the orientation of the profiles in the unlocking section of the slider.

In the cross-sectional view of FIG. 3, first and second profiles 12, 14 are interlocked in an A-type configuration as shown in FIG. 1. As slider 60 is moved such that the interlocked first and second profiles 12, 14 pass from the interlocking section illustrated in FIG. 3 to the unlocking section illustrated in FIG. 4, slider 60 forces the zipper 10 from the interlocked A-type shape to an unlocked V-type shape. This motion is illustrated in FIG. 6. The configuration of side walls 64, 66 in FIG. 4 unlocks first and second profiles 12, 14 from each other by pulling detent head 45 comprised of male hooks 46, 48 (attached to intermediate inwardly extending male element 44) out of engagement with engagement area 29. This configuration further presses the zipper 10 toward the top of the slider 60.

Figure 7:
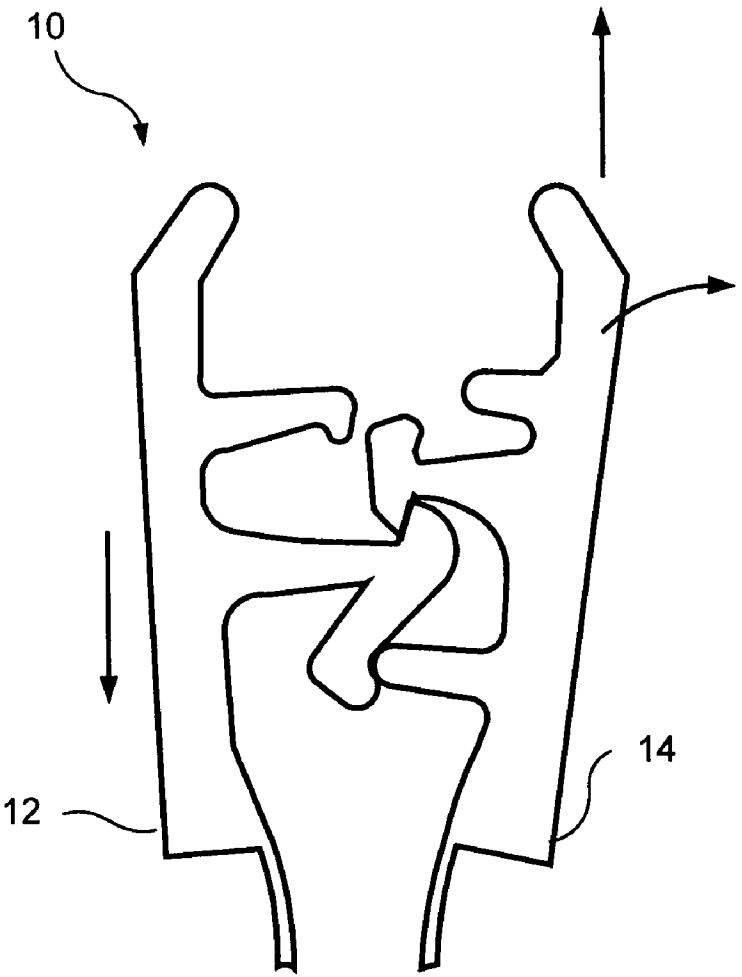
FIG. 7 illustrates the orientation and directions of motion of the profiles in the separating section of the slider.

As slider is subsequently moved from the unlocking section illustrated in FIG. 4 to the separating section illustrated in FIG. 5, the upward offset of inwardly extending flange 70 forces flange 14 upwardly into recess 74. This motion is illustrated in FIG. 7.

When zipper 10 is closed, the interlocking first and second profiles 12, 14 are interlocked in an A-type configuration as shown in FIG. 1. Upper and lower inwardly extending posts 40, 42 of profile 14 are in full contact with upper female leg 18 and the seat of downwardly extending arm 26 and outwardly extending hook 28, respectively, in water-resistant configurations. Slider 60 is positioned with the interlocking section of FIG. 3 facing the interlocked first and second profiles 12, 14. Moving the slider 60 toward the interlocked first and second profiles 12, 14 unlocks the first and second profiles 12, 14 by urging them to a V-shape as shown in FIG. 4 thereby causing lower inwardly extending post 42 to press on downwardly extending arm 26, thereby bending lower female leg 22 thereby releasing upwardly extending female hook 24 from downwardly extending male hook 48. These combined actions unlock the first and second profiles 12, 14 from each other and separate upwardly extending male hook 46 from downwardly extending female hook 20. When the first and second profiles 12, 14 are passed to the separating section of FIG. 5, profile 14 is urged upwardly as described hereinabove thereby separating first and second profiles 12, 14. For all locations where profiles 12, 14 are captured within slider 60, lower inwardly extending post 42 is in full contact with downwardly extending arm 26, thereby making zipper 10 water-resistant.

Figure 9:
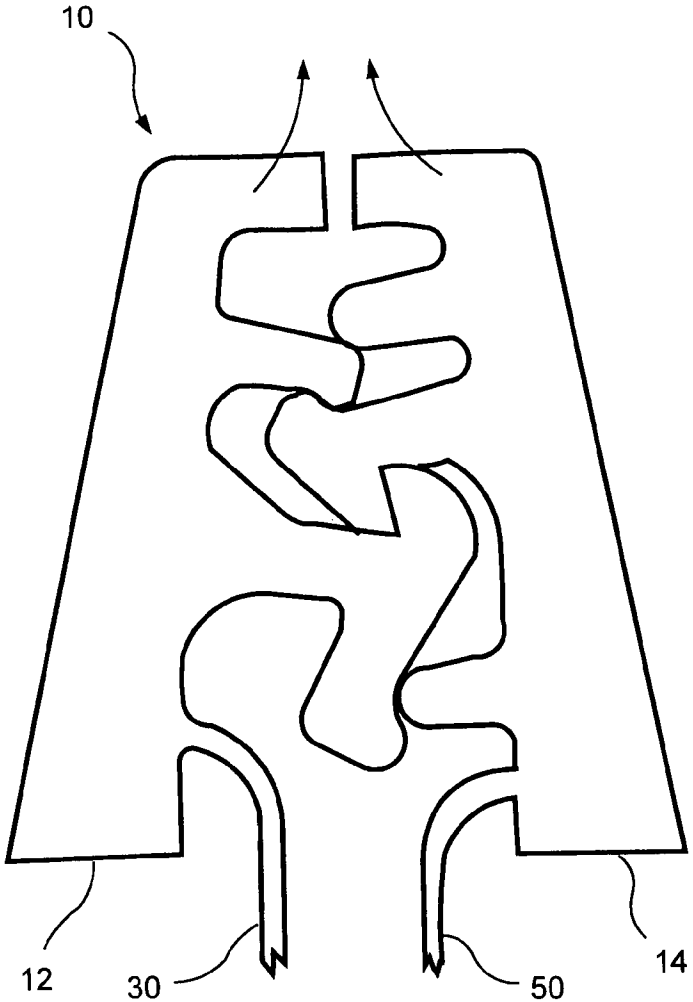
FIG. 9 illustrates the orientation and directions of motion of the profiles when the slider is urged upwardly by the end stop.
Figure 8:
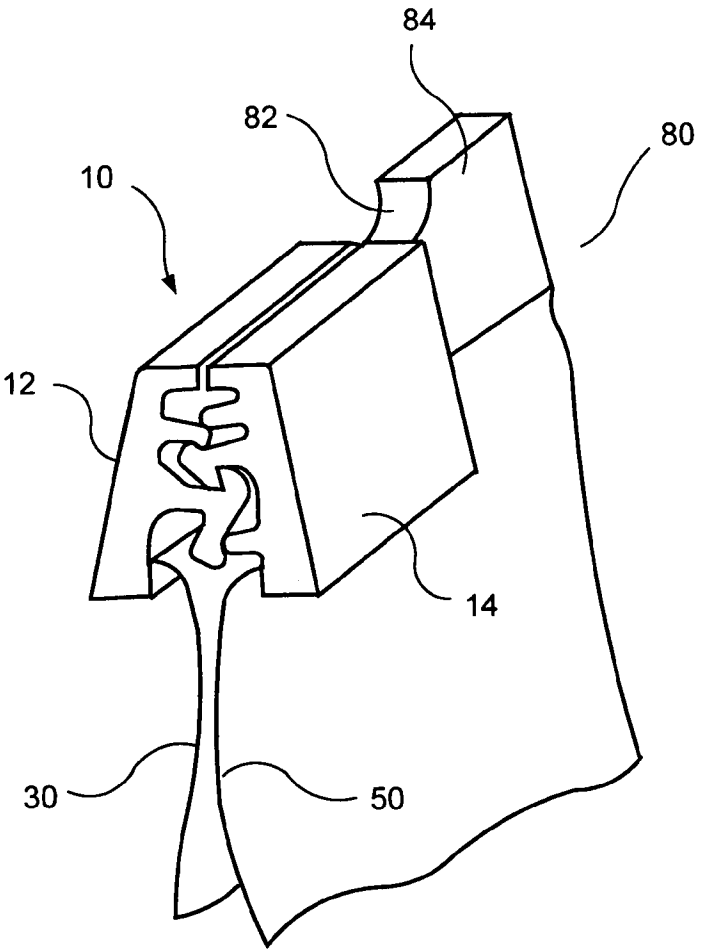
FIG. 8 is a perspective view of the end stop of the zipper of the present invention.

As shown in FIG. 8, the longitudinal ends of first and second profiles 12, 14 are terminated and joined by end stop 80. End stop 80 includes inclined surface 82 reaching plateau 84 above the level of the first and second profiles 12, 14. This results in a stronger end stop 80 and can be configured to urge the slider 60 upwards as slider engages inclined surface 82 thereby urging first and second profiles 12, 14 upwards as shown in FIG. 9.

Thus the several aforementioned objects and advantages are most effectively attained. Although a preferred embodiment of the invention has been disclosed and described in detail herein, it should be understood that this invention is in no sense limited thereby and its scope is to be determined by that of the appended claims.

What is claimed is:

1. A zipper for a reclosable bag, comprising:

a first profile and a second profile;

said first profile including a first inwardly extending leg and a second inwardly extending leg thereby forming an engagement area therebetween;

said first inwardly extending leg terminating in a downwardly extending arm;

said second profile including an inwardly extending male element terminating in an enlarged detent element received within said engagement area when said first and second profiles are interlocked with each other;

said second profile further including a first post which, when said first profile and said second profile are interlocked with each other, urges against said downwardly extending arm, and, when further pressed against said downwardly extending arm, bends said first inwardly extending leg thereby releasing said enlarged detent element from said engagement area;

a slider which interlocks said first profile to said second profile when moved in a first direction and which unlocks said first profile from said second profile when moved in a second direction:

wherein said first inwardly extending leg further terminates in a hook which extends into said engagement area and said second inwardly extending leg terminates in a second hook which extends into said engagement area whereby, when said first profile and said second profile are interlocked with each other, said first and second hooks engage said enlarged detent element;

wherein said downwardly extending arm terminates in an outwardly extending hook whereby, when said first profile and said second profile are interlocked with each other, said first post urges against a seat formed by said downwardly extending arm and said outwardly extending hook thereby forming a water-resistant configuration;

wherein said first post urges against said seat thereby forming a water-resistant configuration at locations where said first profile and said second profile are captured within said slider;

wherein said second profile further includes a second post, whereby when said first profile and said second profile are interlocked with each other, said second post is urged against said second inwardly extending leg.

2. The zipper of claim 1 wherein said slider includes a top wall with side walls extending therefrom, the interior of said side walls forming an interlocking section, an unlocking section and a separating section.

3. A zipper for a reclosable bag, comprising:

a first profile and a second profile;

said first profile including a first inwardly extending leg and a second inwardly extending leg thereby forming an engagement area therebetween;

said first inwardly extending leg terminating in a downwardly extending arm;

said second profile including an inwardly extending male element terminating in an enlarged detent element received within said engagement area when said first and second profiles are interlocked with each other;

said second profile further including a first post which urges against said downwardly extending arm when said first profile and said second profile are interlocked with each other;

a slider which interlocks said first profile to said second profile when moved in a first direction and which unlocks said first profile from said second profile when moved in a second direction;

wherein said first inwardly extending leg further terminates in a hook which extends into said engagement area and said second inwardly extending leg terminates in a second hook which extends into said engagement area whereby, when said first profile and said second profile are interlocked with each other, said first and second hooks engage said enlarged detent element;

wherein said downwardly extending arm terminates in an outwardly extending hook whereby, when said first profile and said second profile are interlocked with each other, said first post urges against a seat formed by said downwardly extending arm and said outwardly extending hook thereby forming a water-resistant configuration;

wherein said first post urges against said seat thereby forming a water-resistant configuration at locations where said first profile and said second profile are captured within said slider;

wherein said second profile further includes a second post, whereby when said first profile and said second profile are interlocked with each other, said second post is urged against said second inwardly extending leg;

wherein said slider includes a top wall with side walls extending therefrom, the interior of said side walls forming an interlocking section, an unlocking section and a separating section; and wherein said interlocking section has a cross-sectional shape of an truncated triangle with a relatively smaller end formed at an interior of said top wall; said unlocking section has a cross-sectional shape of an inverted truncated triangle with a relatively larger end formed at an interior of said top wall; and said separating section has a cross-sectional shape wherein an interior of said side walls are relatively parallel to each other.

4. The zipper of claim 3 wherein said side walls of said slider terminate in first and second inwardly extending flanges immediately below said first and second profiles, respectively, in said interlocking section and said separating sections.

5. The zipper of claim 4 wherein, in said separating section, said second inwardly extending flange is upwardly offset and an interior of said top wall includes a recess above said second profile, thereby urging said second profile upwardly with respect to said first profile and separating said first profile from said second profile.

6. The zipper of claim 5 wherein ends of said first profile are sealed to ends of said second profile thereby forming end stops.

7. The zipper of claim 6 wherein said end stops include an inclined surface to urge said slider upwardly as said slider is urged toward said end stops.

* * * * *